US009938037B2

(12) United States Patent
Kocon et al.

(10) Patent No.: US 9,938,037 B2
(45) **Date of Patent: *Apr. 10, 2018**

(54) PACKAGE WITH FLIP-OPEN CLOSURE

(71) Applicant: CRAYOLA, LLC, Easton, PA (US)

(72) Inventors: Bernard J. Kocon, Bethlehem, PA (US); Francisco Rivera, Orefield, PA (US)

(73) Assignee: Crayola, LLC, Easton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/497,929

(22) Filed: Apr. 26, 2017

(65) Prior Publication Data

US 2017/0355482 A1 Dec. 14, 2017

Related U.S. Application Data

(63) Continuation of application No. 14/832,624, filed on Aug. 21, 2015, now Pat. No. 9,694,933.

(Continued)

(51) Int. Cl.
*B65D 5/12* (2006.01)
*B65D 5/66* (2006.01)

(Continued)

(52) U.S. Cl.
CPC ..... *B65D 5/12* (2013.01); *B65D 5/4204* (2013.01); *B65D 5/4208* (2013.01); *B65D 5/66* (2013.01); *B65D 85/28* (2013.01)

(58) Field of Classification Search
CPC ..... B65D 5/12; B65D 5/4204; B65D 5/4208; B65D 5/66; B65D 85/28

(Continued)

(56) References Cited

U.S. PATENT DOCUMENTS 624,408 A 5/1899 Unser
1,325,041 A 12/1919 Phelps (Continued)

FOREIGN PATENT DOCUMENTS

AU 2012352105 B2 6/2013
CN 201031040 Y 3/2008

(Continued)

OTHER PUBLICATIONS

Notice of Allowance dated May 30, 2017 in U.S. Appl. No. 14/832,624.

*Primary Examiner* — Christopher Demeree
(74) *Attorney, Agent, or Firm* — Shook, Hardy & Bacon L.L.P.

(57) ABSTRACT

A package for containing items having a flip-open package closure is provided. In some embodiments, the package includes a rigid package body and a flexible closure flap. The flexible closure flap is coupled to a hangtab portion of the package body such that the flexible closure flap moves from a closed position to an open position with respect to the package body based on a position of the hangtab portion. An upper edge of a front side of the package body engages the lower portion of the closure flap when the package is closed, while the lower edge of the closure flap is released from the upper edge upon pivoting backward of the hangtab portion. Such pivoting of the hangtab portion, and corresponding manipulation of the closure flap, may occur without directly contacting the closure flap.

18 Claims, 5 Drawing Sheets

Related U.S. Application Data

(60) Provisional application No. 62/040,573, filed on Aug. 22, 2014.

(51) Int. Cl.
*B65D 85/28* (2006.01)
*B65D 5/42* (2006.01)

(58) Field of Classification Search
USPC ..... 229/125.02
See application file for complete search history.

(56) References Cited

U.S. PATENT DOCUMENTS

| | | | |
|---|---|---|---|
| 1,631,595 | A | 6/1927 | Kappes |
| 1,987,804 | A | 1/1935 | Saulsbury |
| 2,036,822 | A | 4/1936 | Myers |
| 2,277,097 | A | 3/1942 | Hansen |
| 2,369,390 | A | 2/1945 | Carruth et al. |
| 2,369,392 | A | 2/1945 | Ringler |
| 3,380,575 | A | 4/1968 | Hennessey |
| 3,625,411 | A | 12/1971 | Cote |
| 3,758,022 | A | 9/1973 | Christensson |
| 3,814,303 | A | 6/1974 | Smith |
| 3,946,936 | A | 3/1976 | Brown |
| 3,985,289 | A | 10/1976 | Prince |
| 4,331,240 | A | 5/1982 | Vanasse |
| 4,355,758 | A | 10/1982 | Lavery |
| 4,646,960 | A | 3/1987 | Challand |
| 4,681,471 | A | 7/1987 | Hayduchok et al. |
| 4,784,315 | A | 11/1988 | Dutcher |
| 4,949,845 | A | 8/1990 | Dixon |
| 5,027,947 | A | 7/1991 | Reighart |
| 5,048,681 | A | 9/1991 | Henkel |
| 5,123,589 | A | 6/1992 | Cote |
| 5,190,200 | A | 3/1993 | Hammerlund |
| 5,263,581 | A | 11/1993 | Rosen |
| 5,429,295 | A | 7/1995 | Levy |
| 5,878,948 | A | 3/1999 | Schultz et al. |
| 5,924,625 | A | 7/1999 | Klein et al. |
| 6,059,113 | A | 5/2000 | Hodges |
| 6,279,819 | B1 | 8/2001 | Schultz et al. |
| 6,312,157 | B1 | 11/2001 | Masuda |
| 6,375,010 | B1 | 4/2002 | Thibault |
| D492,594 | S | 7/2004 | Nash |
| 6,994,246 | B2 | 2/2006 | Ichikawa et al. |
| 7,137,736 | B2 | 11/2006 | Pawloski et al. |
| D536,965 | S | 2/2007 | Levy |
| 7,178,712 | B2 | 2/2007 | Schultz et al. |
| 7,258,233 | B2 | 8/2007 | Lee |
| 7,273,145 | B2 | 9/2007 | Focke et al. |
| 7,306,099 | B2 | 12/2007 | Chen |
| 7,325,686 | B2 | 2/2008 | Aldridge |
| D597,829 | S | 8/2009 | Ma et al. |
| 7,665,600 | B1 | 2/2010 | Griffin |
| D618,541 | S | 6/2010 | Frommeyer et al. |
| D662,811 | S | 7/2012 | Marcinkowski |
| 8,365,978 | B2 | 2/2013 | Yoshimura et al. |
| D681,442 | S | 5/2013 | Kengla |
| 8,453,918 | B2 * | 6/2013 | Hsiao ..... B65D 5/4208 206/806 |
| D691,884 | S | 10/2013 | Kwon |
| 8,607,987 | B2 | 12/2013 | Oja et al. |
| 8,727,124 | B2 | 5/2014 | Franciskovich et al. |
| 8,950,658 | B2 | 2/2015 | Aldridge |
| 9,004,344 | B2 * | 4/2015 | Smith ..... B65D 5/0227 229/126 |
| 9,108,760 | B2 | 8/2015 | Begim |
| 9,138,296 | B2 | 9/2015 | Grabowski |
| 9,533,820 | B2 | 1/2017 | Tanbo et al. |
| D801,803 | S * | 11/2017 | Mitten ..... D9/416 |
| 2001/0008215 | A1 | 7/2001 | Colombo |
| 2002/0029995 | A1 | 3/2002 | Garrett |
| 2012/0187018 | A1 | 7/2012 | Maglio et al. |
| 2014/0103100 | A1 | 4/2014 | Falcon et al. |

FOREIGN PATENT DOCUMENTS

| | | | |
|---|---|---|---|
| CN | 203740369 | U | 7/2014 |
| DE | 102007001978 | A1 | 7/2008 |
| EP | 2085315 | B1 | 1/2011 |
| FR | 2712264 | A1 | 5/1995 |
| GB | 2030111 | A | 4/1980 |
| GB | 2147566 | B | 5/1985 |
| JP | H07137736 | A | 5/1995 |
| JP | 2001114257 | A | 4/2001 |
| JP | 3190296 | B2 | 7/2001 |
| JP | 2003040330 | A | 2/2003 |
| JP | 3467646 | B2 | 11/2003 |
| JP | 4901342 | B2 | 3/2012 |
| JP | 3177596 | U | 8/2012 |
| JP | 5128770 | B2 | 1/2013 |
| JP | 5341271 | B1 | 11/2013 |
| KR | 101254854 | B1 | 4/2013 |
| NL | 9202215 | A | 7/1994 |
| WO | 9961343 | A1 | 12/1999 |
| WO | 2010065029 | A1 | 6/2010 |
| WO | 2012174186 | A1 | 12/2012 |

* cited by examiner

PACKAGE WITH FLIP-OPEN CLOSURE

CROSS-REFERENCE TO RELATED APPLICATION

This application is a continuation of co-pending U.S. patent application Ser. No. 14/832,624, filed Aug. 21, 2015, entitled "Package with Flip-Open Closure," which claims priority to U.S. Provisional Patent Application No. 62/040,573, filed Aug. 22, 2014, entitled "Package with Flip-Open Closure," the entire contents of which are incorporated herein by reference in their entirety.

SUMMARY

Embodiments of the invention are defined by the claims below, not this summary. A high-level overview of various aspects of the invention are provided here for that reason, to provide an overview of the disclosure, and to introduce a selection of concepts that are further described in the detailed description section below. This summary is not intended to identify key features or essential features of the claimed subject matter, nor is it intended to be used as an aid in isolation to determine the scope of the claimed subject matter.

In brief and at a high level, this disclosure describes, among other things, a package with a flip-open closure for storing and displaying objects, such as an assortment of writing utensils (e.g., crayons, markers, pens, pencils, etc.). In some aspects, the flip-open closure includes a clear plastic closure flap that tucks under the front of the package when closed. The clear plastic closure flap may be made from a moveable and/or flexible material that bends and/or shifts during manipulation of the flip-open features of the package. In further aspects, the clear plastic closure flap may be coupled directly or indirectly to a top portion of the package, such as a hangtab at a top portion of the package (e.g., a cardboard hangtab). From a closed position, the hangtab portion may be bent backward, thereby pulling the closure flap out from underneath the front of the package to release the closure flap and open the package. Such manipulation of the hangtab, and corresponding opening of the clear plastic closure flap, may be performed during a synchronized motion of bending and opening of the package, such as by a single hand of a user, in some embodiments.

Further embodiments of the invention are directed to a package having a flip-open closure feature (i.e., a "Flip-N-Close" package), having a flexible, reusable carton closure that provides product visibility while creating a durable storage vehicle for products in a carton. In some aspects of the invention, the clear plastic closure flap is made at least in part from a polyethylene terephthalate (PET) material that allows for viewing of the product when closed. In further aspects of the invention, the clear plastic closure flap is made from another see-through, flexible, plastic material other than or in addition to PET. As such, embodiments of the package closure include a flexible and/or bendable clear plastic closure flap that tucks under the front of the package. The flexible closure flap may be attached to and/or integrated into a body of the package, such as a cardstock hangtab at a top of the package. In such embodiments, when the hangtab portion of the package body is bent in a backward direction, away from the front of the package body, the flexible closure flap is pulled in such direction and removed from an interior of the package. As such, by virtue of the flexible closure flap being attached to the hangtab portion of the package, the flexible closure flap is pulled and/or slides out from underneath the front of the package.

In one aspect of the invention, a package for containing items having a flip-open package closure is provided. Embodiments of the package include a package body having a front side with an upper edge, a back side with a hangtab portion, and a closure flap coupled to the package body. In embodiments, the closure flap includes a lower portion configured to remain secured below the upper edge of the front side when the package is in a closed position. In further aspects, the lower portion is configured to open at least a portion of the package body in response to bending of the hangtab portion in a backward direction.

Further embodiments of the invention are directed to a flip-open package for containing items. The flip-open package includes: a first side having a first length and an upper edge; a second side opposite the first side, the second side having a second length that is longer than the first length, with a portion of the second side that is longer than the first side comprises a hangtab portion; a closure flap including a clear plastic material, with an upper edge of the closure flap coupled to the hangtab portion, and further where at least a portion of a lower edge of the closure flap is configured to engage at least a portion of the upper edge of the first side when the flip-open package is in a closed position, and further where the lower edge of the closure flap is configured to disengage from the upper edge of the first side when the flip-open package is in an open position, where the flip-open package is configured to move between the closed position and the open position based on a position of the hangtab portion of the second side.

In another embodiment of the invention, a package for enclosing items having a flip-open package closure is provided. The package includes: a front side having a first length and an upper edge; a back side having a second length greater than the first length, where the back side includes a hangtab portion extending a distance above the upper edge; a bendable flap closure having a lower portion configured to engage at least a portion of the upper edge of the front side when in an open position, wherein the lower portion of the bendable flap closure is further configured to disengage from the upper edge of the front side in response to bending of the hangtab portion in a backward direction away from a plane of the back side.

In one embodiment, a package for containing items having a flip-open package closure includes a package body having (1) a front side comprising an upper edge; and (2) a back side comprising a hangtab portion. The package further includes a closure flap coupled to the package body, wherein the closure flap comprises a lower portion configured to remain secured below the upper edge of the front side when the package is in a closed position. In embodiments, the lower portion is configured to open at least a portion of the package body in response to bending of the hangtab portion in a backward direction.

In another embodiment, a flip-open package for containing items includes a package body having a first material, said package body comprising: (1) a package body first side having a first length and an upper edge, and (2) a package body second side opposite the package body first side, the package body second side having a second length that is longer than the first length, wherein a portion of the package body second side that is longer than the package body first side comprises a hangtab portion. The package further includes a closure flap comprising a second material different than the first material, wherein an upper edge of the closure flap is coupled to the hangtab portion, and further wherein at least a portion of a lower edge of the closure flap is configured to engage at least a portion of the upper edge of the first side when the flip-open package is in a closed position, and further wherein the lower edge of the closure flap is configured to disengage from the upper edge of the first side when the flip-open package is in an open position, wherein the flip-open package is configured to move between the closed position and the open position based on a position of the hangtab portion of the second side.

In yet another embodiment, a package for enclosing items having a flip-open package closure includes: a package body front side having a first length and an upper edge; a package body back side opposite the package body front side, said package body back side having a second length greater than the first length, wherein the package body back side comprises a hangtab portion; a package body left side adjacent the package body front side and the package body back side; a package body right side adjacent the package body front side and the package body back side, said package body right side opposite the package body left side, wherein the package body front side, package body back side, package body left side, and package body right side comprise a first material; and a bendable closure flap coupled to the package body, said bendable closure flap comprising a second material different than the first material. In embodiments, the bendable closure flap includes: (1) an upper portion configured to engage an upper edge of the package body left side and the package body right side; (2) a middle portion configured to engage at least a portion of an outer edge of the package body left side and the package body right side; and (3) a lower portion configured to engage at least a portion of the upper edge of the package body front side, wherein the bendable closure flap is configured to engage or disengage from at least a portion of the package body in response to bending of the hangtab portion with respect to a plane of the package body back side.

DESCRIPTION OF THE DRAWINGS

Illustrative embodiments of the invention are described in detail below with reference to the attached drawing figures, and wherein.

DETAILED DESCRIPTION

Figure 1:
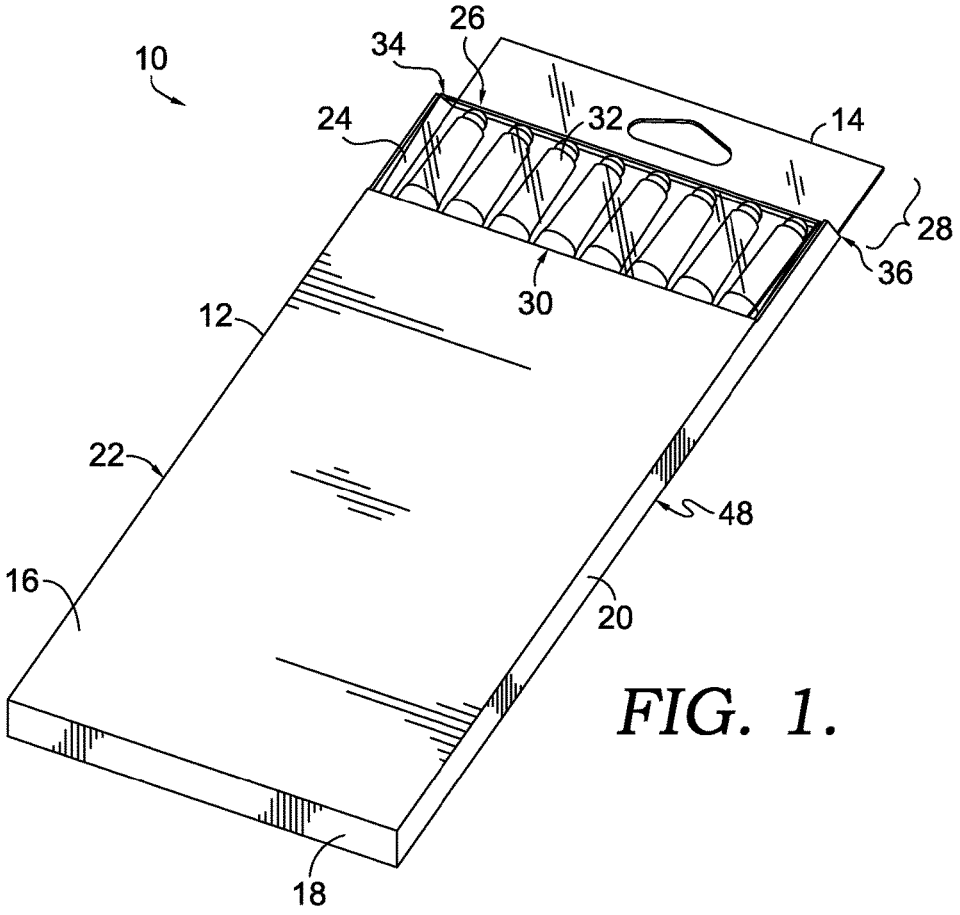
FIG. 1 is a front, perspective view of a closed, flip-open package with a clear plastic flap and items inside the package, in accordance with an embodiment of the invention.

The subject matter of embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Embodiments of the invention include a package with a flip-open closure for storing and displaying objects, such as an assortment of writing utensils (e.g., crayons, markers, pens, pencils, etc.). In some aspects, the flip-open closure includes a clear plastic closure flap that tucks under the front of the package when closed. The clear plastic closure flap may be made from a moveable and/or flexible material that bends and/or shifts during manipulation of the flip-open features of the package. In further aspects, the clear plastic closure flap may be coupled directly or indirectly to a top portion of the package, such as a hangtab at a top portion of the package (e.g., a cardboard hangtab). From a closed position, the hangtab portion may be bent backward, thereby pulling the closure flap out from underneath the front of the package to release the closure flap and open the package. Such manipulation of the hangtab, and corresponding opening of the clear plastic closure flap, may be performed during a synchronized motion of bending and opening of the package, such as by a single hand of a user, in some embodiments.

Further embodiments of the invention are directed to a package having a flip-open closure feature (i.e., a "Flip-N-Close" package), having a flexible, reusable carton closure that provides product visibility while creating a durable storage vehicle for products in a carton. In some aspects of the invention, the clear plastic closure flap is made at least in part from a PET material that allows for viewing of the product when closed. In further aspects of the invention, the clear plastic closure flap is made from another see-through, flexible, plastic material other than or in addition to PET. As such, embodiments of the package closure include a flexible and/or bendable clear plastic closure flap that tucks under the front of the package. The flexible closure flap may be attached to and/or integrated into a body of the package, such as a cardstock hangtab at a top of the package. In such embodiments, when the hangtab portion of the package body is bent in a backward direction, away from the front of the package body, the flexible closure flap is pulled in such direction and removed from an interior of the package. As such, by virtue of the flexible closure flap being attached to the hangtab portion of the package, the flexible closure flap is pulled and/or slides out from underneath the front of the package.

With reference now to the figures, a package with a flip-open closure is described in accordance with embodiments of the invention. Various embodiments are described with respect to the figures in which like elements are depicted with like reference numerals.

Referring initially to FIG. 1, a front, perspective view of a closed, flip-open package 10 is depicted according to an embodiment of the invention. The package 10 includes a package body 12, with a front side 16, a back side 48, a top 14, a bottom 18, a right side 20, a left side 22, a closure flap 24 having a closure flap top 26, and a hangtab portion 28. In some embodiments of the invention, the package body 12 is made from a rigid material having less flexibility than the material used for the closure flap 24. In one aspect, the package body 12 is a cardboard material having an opaque and/or solid appearance and/or structure that provides support for and gives structure to the package 10. Additionally, the package body 12 may be assembled in a variety of configurations, including a box-like structure as depicted in the example of FIG. 1 with the front side 16 opposite the back side 48, the left side 22 opposite the right side 20, and a top 14 opposite a bottom 18 that is adjacent to at least a portion of the front side 16, back side 48, the left side 22, and right side 20, for example.

In some embodiments, the front side 16 is a different shape and/or size than the back side 48 of the package body 12, such as being different sizes of rectangles. Additionally, the back side 48 may extend a distance beyond an upper edge 30 of the front side 16, and/or an upper edge of one or both of the left side 22 and right side 20, as shown in FIG. 1, to provide a storage compartment where at least a portion of the contents are exposed with respect to at least one side of the package body 12. In further embodiments, the back side 48 of the package body 12 may extend a distance past the right and left sides 20 and 22 at the top 14, to provide a hangtab portion 28 that meets with the remainder of the package body 12 at a pivot point 36. Additionally, the hangtab portion 28 may be coupled to at least a portion of the closure flap 24 at or near the pivot point 36. In some aspects, the hangtab portion 28 may include both a portion of the material of the back side 48 and a portion of the material of the closure flap 24. For example, the hangtab portion 28 may include a cardboard material associated with the package body 12, while integrating and/or coupling to the closure flap 24. In one embodiment of the invention, at least a portion of the closure flap 24 is coupled to at least a portion of the back side 48 of the package body 12. As such, movement of the hangtab portion 28 may correspond to movement of at least a portion of the closure flap 24, as further discussed below.

As further depicted in FIG. 1, a portion of the closure flap 24 may be positioned within an interior of the package body 12. For example, the closure flap 24 may be tucked underneath the upper edge 30 of the front side 16. As such, the contents of the package body 12 may be retained by a combination of package 10 surfaces and/or features, including the right side 20, left side 22, bottom 18, back side 48, front side 16, and closure flap 24. In some embodiments, the right side 20, left side 22, bottom 18, back side 48, front side 16, and closure flap 24 provide an interior cavity of the package body 12, into which the closure flap may be partially "tucked in." Accordingly, a number of stored items 32 may be enclosed within the package body 12, such as the marking instruments depicted in FIG. 1.

With continued reference to FIG. 1, the closure flap 24 may include a closure flap top 26 created based on a crease and/or fold 34 in at least a portion of the closure flap 24 material. For example, the closure flap 24 may include a fold 34 that distinguishes a portion of the closure flap top 26 from the rest of the closure flap 24. In the example of FIG. 1, the closure flap top 26 is approximately the same depth as the package body 12 (i.e., the width of one or both of the right side 20 and left side 22). In another example, the fold 34 creates a hinged feature such that the surfaces of the closure flap top 26 and the remainder of the closure flap 24 face in different directions. In one embodiment of the invention, at least a portion of the closure flap 24 is coupled to at least a portion of the back side 48 of the package body 12. As such, movement of the hangtab portion 28 may correspond to movement of at least a portion of the closure flap 24, as further discussed below.

Figure 2:
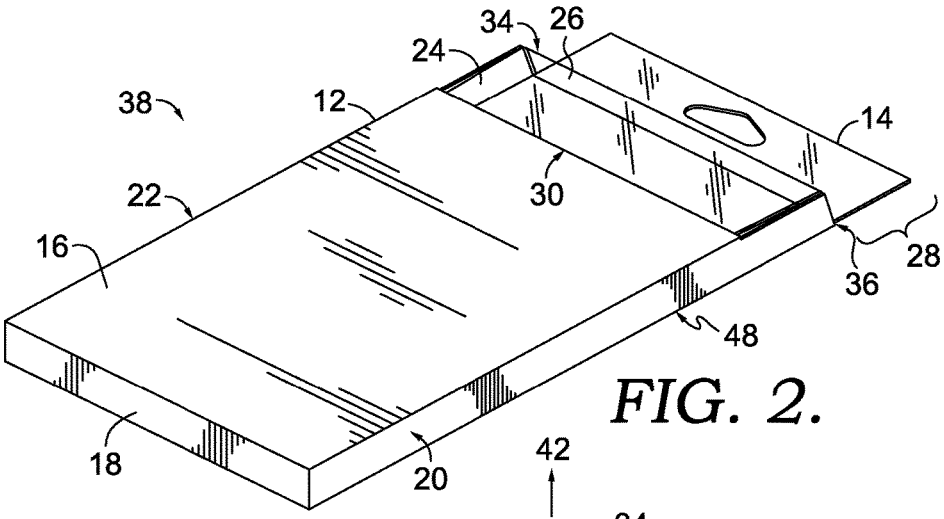
FIG. 2. is a side, perspective view of the flip-open package of FIG. 1 with the clear plastic closure flap tucked underneath the front of the package, with no items inside the package, in accordance with an embodiment of the invention.

With reference now to FIG. 2, a side, perspective view depicts an empty package 38 in a closed position, without stored items 32. In the embodiment of FIG. 2, the clear plastic closure flap 24 is tucked underneath the front side 16 of the package body 12. In some aspects, in the closed position of FIG. 2, the hangtab portion 28 is in a straight position along a same line as the rest of the back side 48. In other words, with the hangtab portion 28 in a neutral position with respect to pivot point 36 (i.e., in the same plane as the back side 48), the closure flap 24 remains tucked into the upper edge 30 of the package body 12. In one embodiment, a user may manually tuck in the closure flap 24 into the interior of the package body 12 based on bending at least a portion of the closure flap 24 and tucking it under and/or behind the upper edge 30.

Figure 3:
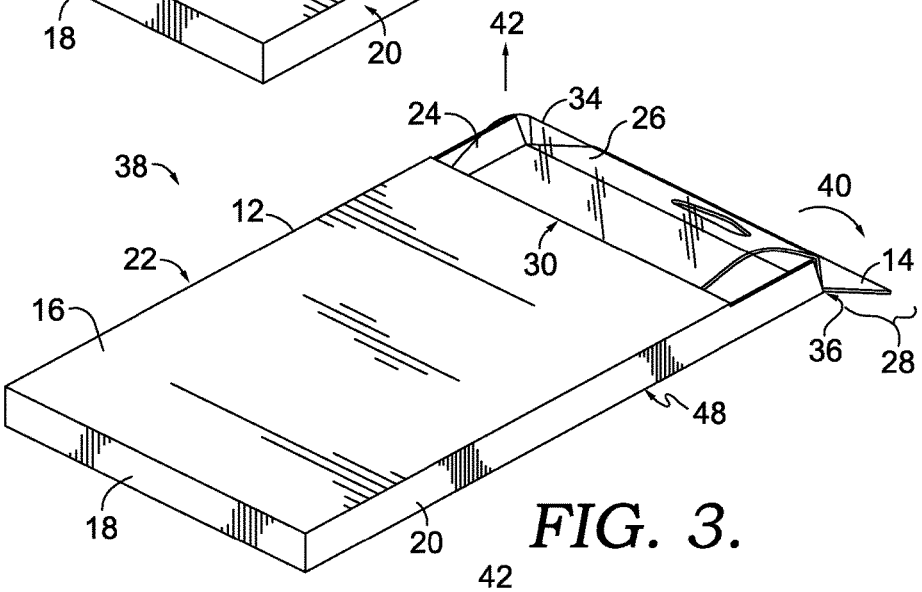
FIG. 3 is a side, perspective view of a flip-open package, with the package hangtab partially bent in a backward direction at a first distance and the clear plastic closure flap partially untucked from the package front, in accordance with an embodiment of the invention.

As shown in FIG. 3, once the hangtab portion 28 begins to bend at the pivot point 36 in a backward direction 40 away from the plane of the back side 48, the package 38 begins to open. As such, FIG. 3 depicts an exemplary perspective view of a flip-open package 38 with the hangtab portion 28 of the back side 48 partially bent backward at a first distance from the back side 48. As a result of such pivoting, the clear plastic closure flap 24 begins to be partially removed and/or "untucked" from the package 38 front side 16, in accordance with an embodiment of the invention. In one embodiment, based on movement of the hangtab portion 28 in the backward direction 40, at least a portion of the closure flap 24 begins to rise in an upward direction 42, away from the front side 16. In one example, the movement of the hangtab portion 28 in a backward direction 40, about pivot point 36, corresponds to movement of at least a portion of the closure flap 24 in an upward direction 42.

Figure 4:
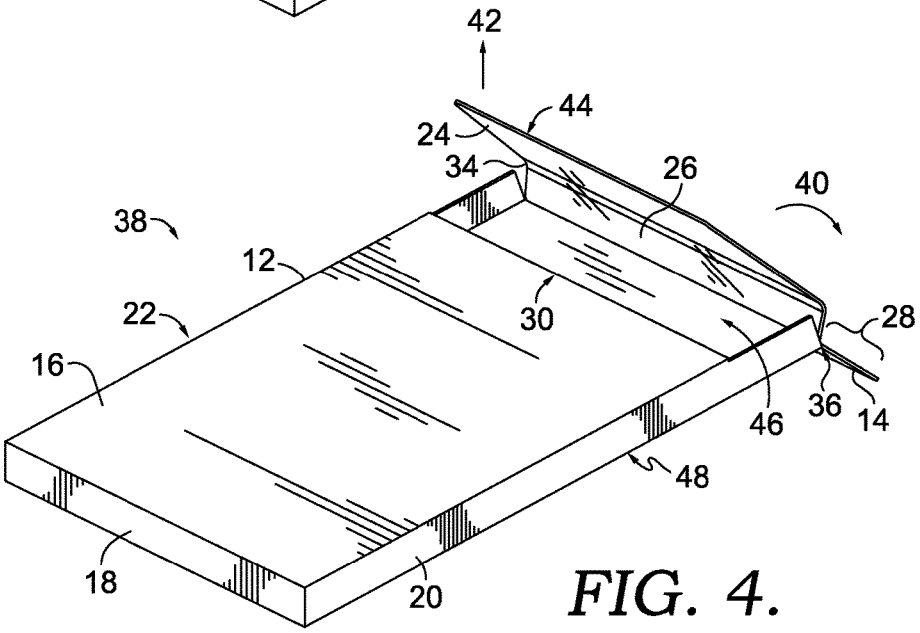
FIG. 4 is a side, perspective view of a flip-open package, with the package hangtab bent at a second distance that is further backward than the first distance to provide an opened package with the clear plastic closure flap withdrawn from underneath the package front, in accordance with an embodiment of the invention.

With reference to the exemplary embodiment of FIG. 4, a side, perspective view of a flip-open package 38 is depicted with the hangtab portion 28 bent backward at a second distance that is further backward than the first distance to provide an opened package. As such, in the open position of FIG. 4, the clear plastic closure flap 24 is withdrawn from underneath the package front 16 based on rotation of the hangtab portion 28 in the backward direction 40, away from the plane of the remaining portion of the back side 48. In response to the additional pivoting between the positioning of FIGS. 3 and 4 (i.e., further pivoting of the hangtab portion 28 about the pivot point 36), the lower portion 44 of the closure flap 24 becomes exposed and/or removed from within the package body 12. In other words, the lower portion 44 of the closure flap 24 becomes "untucked" based on rotation of the hangtab portion 28, and corresponding advancement of the closure flap 24 in an outward and upward direction. As shown in the example of FIG. 4, based on a rigidity of the plastic material used for the closure flap 24, at least a portion of the closure flap 24 may automatically open the package 38. In doing so, the lower portion 44 may "spring" out from being restrained by the upper edge 30 of the front side 16 to provide access to the inner cavity 46 of the package body 12. In further aspects, at least a portion of the closure flap 24 is coupled to at least a portion of the hangtab portion 28 such that movement of the hangtab portion 28 pulls on an end of the closure flap 24 in a direction away from the upper edge 30 of the front side 16.

Based on one or more features of the package 38, a user may manipulate the hangtab portion 28 by bending it in a backward direction 40, causing the subsequent opening of the closure flap 24. In one example, the lower portion 44 is pulled from underneath the upper edge 30 of the front side 16 based on coupling of at least a portion of the closure flap 24 to at least a portion of the package body 12, and on a travel distance of the hangtab portion 28. In further embodiments of the invention, a user may be provided with quick and/or easy access to the inner cavity 46 of the package body 12 based on manual bending of a portion of the backside 48 (i.e., the hangtab portion 28), which triggers the release of the closure flap 24.

In one embodiment, the lower portion 44 of the closure flap 24 is hinged at the fold 34 such that release of the lower edge 44 from the front side 16 results in the upward motion of the lower portion 44 away from the closure flap top 26. In some embodiments, the flip-open package 38 may be opened by a single-handed operation, thereby allowing access to the contents of the flip-open package 38 without additional manual manipulation from a second hand. In further embodiments, a user may return the flip-open package 38 to a closed position based on tucking the closure flap 24 into the package body again (i.e., under the upper edge 30 of the front side 16), which may again be released from the closed position based on subsequent rotation of the hangtab portion 28.

Figure 5:
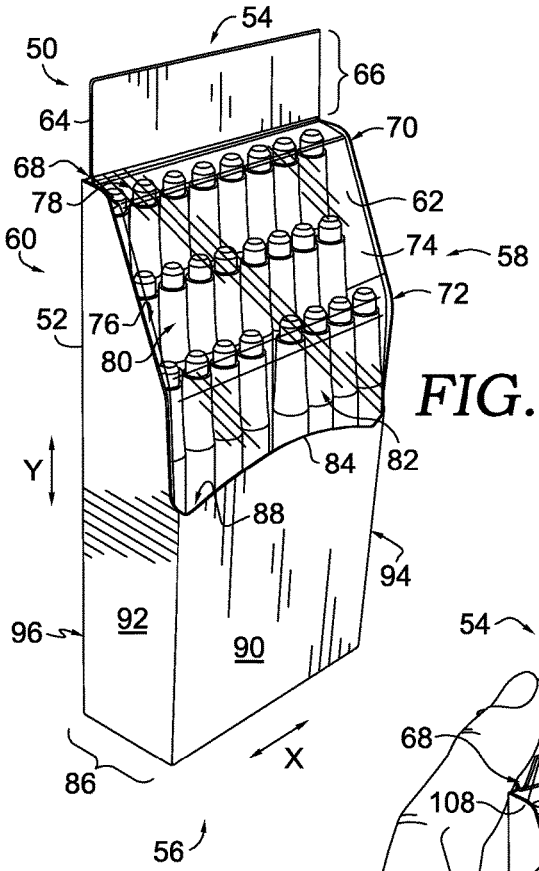
FIG. 5 is a front, perspective view of a closed, flip-open package with a clear plastic flap and items inside the package, in accordance with an embodiment of the invention.

Turing next to FIG. 5, an exemplary flip-open package 50 includes a package body 52 with an upper end 54 opposite a lower end 56, a package front 58 opposite a package back 60, and a closure flap 62 contoured at least in part to an outer edge of the sides of the flip-open package 50. The package body 52 may be made from a first material having a first attribute while the closure flap 62 is made from a second material having a second attribute different from the first attribute. For example, the package body 52 may be made from a rigid material having less flexibility than the semi-rigid, second material used for the closure flap 62. In one aspect, the package body 52 may be a cardboard material having an opaque and/or solid appearance that provides a structure of the package body 52 for selectively securing and/or enclosing one or more items within the package body 52 based on a position of the transparent, plastic closure flap 62.

In further aspects, the package body 52 may be assembled in a variety of configurations, including a box-like structure as depicted in the example of FIG. 5 with the front side 90 opposite the back side 96, the left side 92 opposite the right side 94, and the bottom 86 adjacent at least a portion of each of the front side 90, back side 96, left side 92, and right side 94, for example. As such, an interior cavity 88 may be secured within the box-like structure of the package body 52 for holding one or more articles. As will be understood, a size and/or dimension of one or more sides of the package body 52 may be a different shape or orientation with respect to the remaining portions of the flip-open package 50. For example, while the exemplary embodiment of FIG. 5 includes a rectangular bottom 86, further embodiments of the invention include a variety of shapes of package body 52 features, such as oval-shaped bottoms 86, or other configurations. Similarly, while the closure flap 62 of the example of FIG. 5 is depicted as having a particular molding, hinging, positioning, and/or shape, additional embodiments of the invention provide various configurations of a closure flap 62 having more flexibility than the material of the corresponding package body 52, and further may include one or more different orientations corresponding to an outer edge of the sides of the package body 52, such as the left side 92 and right side 94.

In some embodiments, the front side 90 is a different shape, size, and/or height than the back side 96 of a particular package body 52, such as a taller back side 96 having a first length with a shorter front side 90 having a second length less than the first length. As such, contents of the flip-open closure may be both viewed from a package front 58 and accessed at least in part from the package front 58. In one embodiment, the back side 96 and the front side 90 are parallel portions of the package body 52 with an offset outer perimeter, such as the upper edge 84 at a distance below the upper end 54 of the back side 96. In another embodiment, the left side 92 and the right side 94 are parallel portions of the package body 52 with mirror image outer perimeters such that the contoured shape of at least a portion of the closure flap 62 is configured to adjoin at least a portion of an exposed outer edge.

In further embodiments of the invention, the back side 96 may extend along the y-axis at a particular distance beyond an upper edge of the front side 90, left side 92, and right side 94, as shown in FIG. 5. Accordingly, the back side 96 of the package body 52 may extend a distance past the upper edge of the right and left sides 94 and 92, to provide a hangtab portion 66 that meets with the remainder of the package body 52 at a pivot point 68. In one embodiment of the invention, the hangtab portion 66 includes a secured feature 64 that couples the first material of the back side 96 with the second material of the closure flap 62 such that rotation of the hangtab portion 66 corresponds to travel of at least a portion of the back side 96 and at least a portion of the closure flap 62.

As further depicted in FIG. 5, a portion of the closure flap 62 may be positioned within an interior of the package body 52. For example, the closure flap 62 may be tucked underneath the upper edge 84 of the front side 90. As such, the contents of the package body 52 may be retained by a combination of multiple flip-open package 50 surfaces and/or features, including the right side 94, left side 92, bottom 86, back side 96, front side 90, and closure flap 62. In some embodiments, the right side 94, left side 92, bottom 86, back side 96, front side 90, and closure flap 62 provide an interior cavity 88 of the package body 52, into which the closure flap may be partially "tucked in." Accordingly, a number of stored items 116 may be enclosed within the package body 52, such as the marking instruments depicted in FIG. 5.

Figure 6:
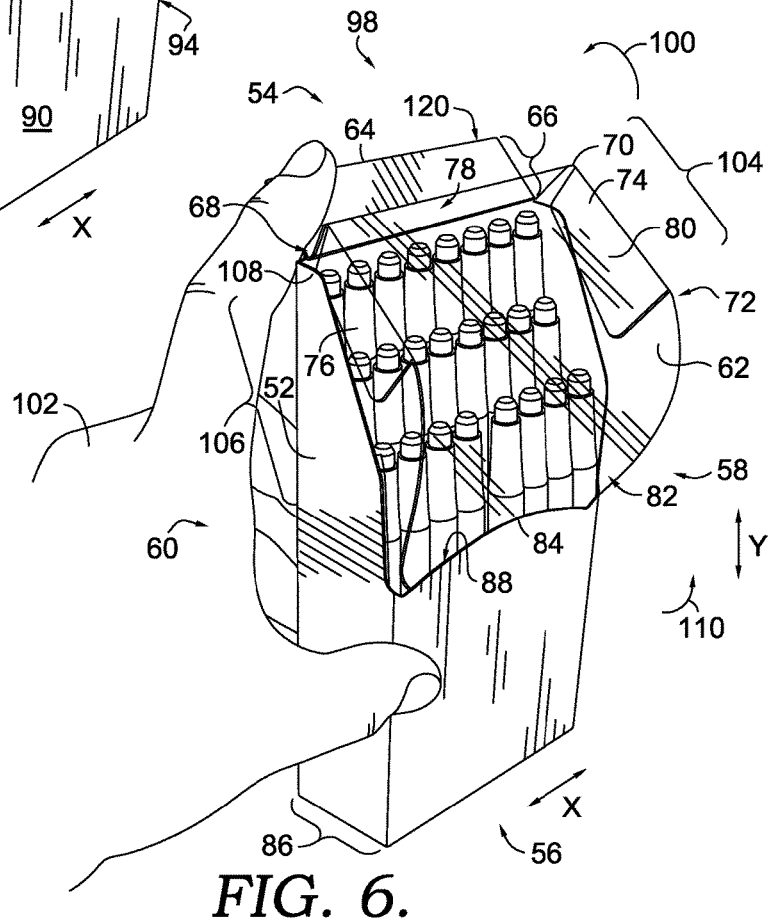
FIG. 6 is a side, perspective view of a flip-open package, with the package hangtab partially bent in a backward direction at a first distance and the clear plastic closure flap partially untucked from the package front, in accordance with an embodiment of the invention.

With reference to the exemplary embodiments of FIG. 5-6, the closure flap 62 may include a one or more portions of the flap material, such as a plastic, pliable material, that are defined at least in part by one or more folds and/or creases in the closure flap 62 material. In one embodiment, the closure flap 62 includes a closure flap top portion 78, a middle portion 80, and a bottom portion 82. Further, a first fold 70 between the top portion 78 and the middle portion 80 may define the top and middle portions 78 and 80, while the second fold 72 is positioned between the middle portion 80 and bottom portion 82. In one example, the closure flap 62 may include a first fold 70 that distinguishes a portion of the closure flap top portion 78 from the rest of the closure flap 62, providing an upper surface along the top portion 78 that is substantially parallel to the bottom 86 of the package body 52. In one embodiment, a dimension of the top portion 78 corresponds to an upper edge 108 of the left side 92 and/or right side 94 to provide an enclosed upper end 54.

Additionally, the closure flap 62 may include a second fold 72 that distinguishes a portion of the closure flap middle portion 80 from the closure flap bottom portion 82, providing a middle surface along the middle portion 80 that corresponds to the incline edge 106 of the left side 92 and/or right side 94. In some aspects, the first fold 70 and the second fold 72 are hinged features along the pliable surface of the closure flap 62 of the flip-open package 50. Based on a position of one or more hinges along the closure flap 62, different portions of the closure flap 62 may face in different directions, such as the first plane of the top portion 78, the second plane of the middle portion 80, and the third plane of the bottom portion 82. In one embodiment, the closure flap 62 is the same width as the front side 90, while the top portion 78 is the same depth as the upper edge 108, as shown in FIG. 6. In further aspects, the middle portion 80 includes a left tab 76 and a right tab 74 on opposing sides of the closure flap 62. The left tab 76 and right tab 74 correspond to the incline edge 106 of the left side 92 and right side 94 of the package body 52. As such, additional folds along the edges of the left tab 76 and right tab 74 may form a hinge between the middle portion 80 and the adjoining tabs. In one embodiment, the left tab 76 and right tab 74 are perpendicular to the middle portion 80 of the closure flap 62.

In one embodiment of the invention, at least a portion of the closure flap 62 is coupled to at least a portion of the back side 96 of the package body 52. As such, movement of the hangtab portion 66 may correspond to movement of at least a portion of the closure flap 62, as further discussed below. In the closed position of FIG. 5, the closure flap 62 is tucked underneath the front side 90 of the package body 52. In some aspects, while in the closed position, the hangtab portion 66 is in a straight position along the y-axis with the rest of the back side 96. In this example, the hangtab portion 66 is in a neutral position with respect to the pivot point 68, with the closure flap 62 tucked into the upper edge 84 of the front side 90. In one embodiment, a user may manually tuck the closure flap 62 into the interior of the package body 52 based on bending at least a portion of the lower portion 82 and/or middle portion 80 of the closure flap 62, behind the upper edge 84 and into the interior cavity 88.

As shown in FIG. 6, once the hangtab portion 66 is rotated at the pivot point 68 in a backward direction 100 away from the plane of the back side 96, the flip-open package 98 begins to open. As a result of such pivoting, the clear plastic closure flap 62 begins to be partially removed and/or "untucked" from the flip-open package 98 front side 90, in accordance with an embodiment of the invention. In one embodiment, based on movement of the hangtab portion 66 in the backward direction 100, at least a portion of the closure flap 62 begins to rise in an upward direction 110, away from the upper edge 84 of the front side 90. In one example, movement of the hangtab portion 66 in a backward direction 100, about pivot point 68, corresponds to movement of at least a portion of the closure flap 62 in an upward direction 110 to expose at least a portion of the contents of the flip-open package 98. As such, based on coupling between the first material of the package body 52 and the second material of the closure flap 62, the rotation of the hangtab portion 66 may adjust the flip-open package 98 from a closed position to an open position without needing to manually untuck the bottom end 82 of the closure flap 62 from the upper edge 84 of the front side 90.

Figure 7:
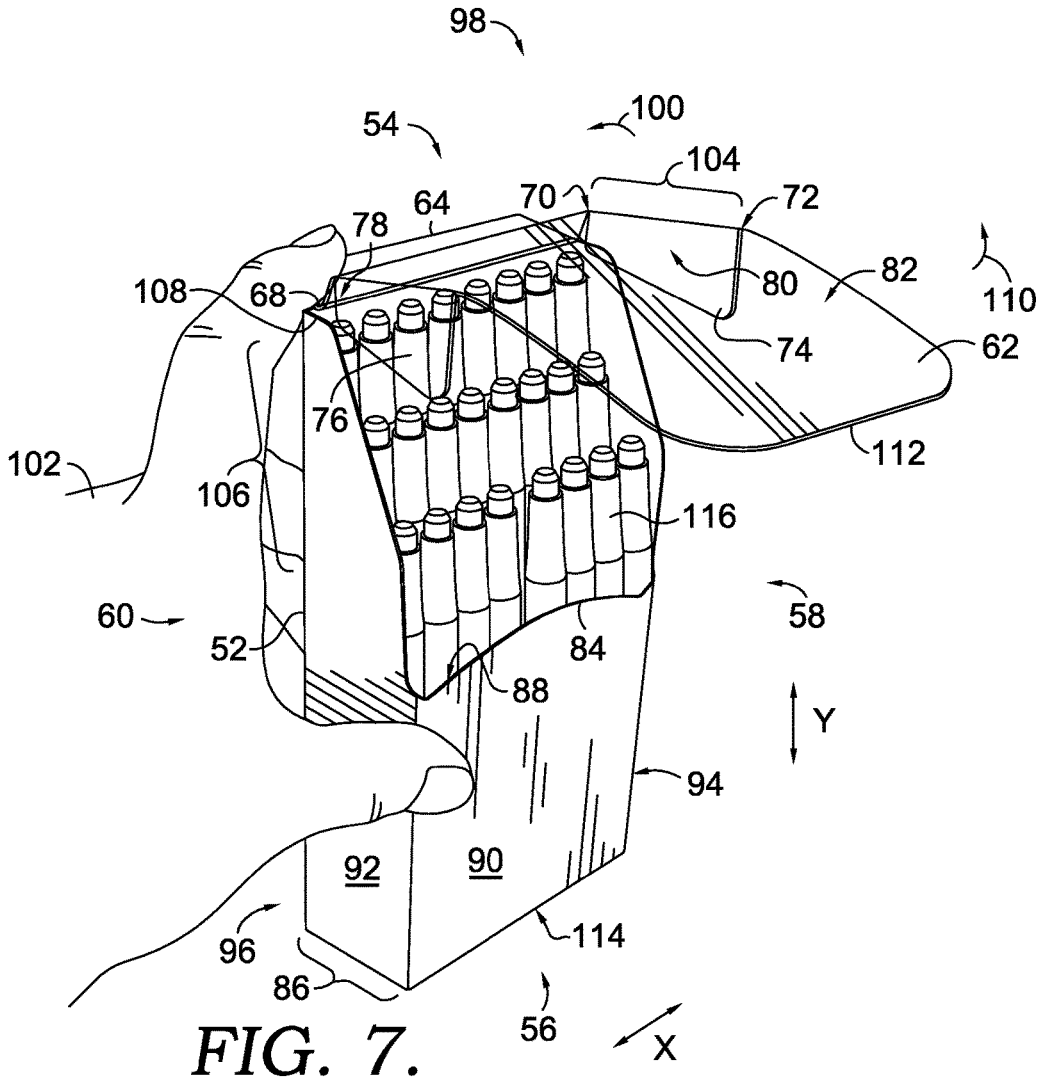
FIG. 7 is a side, perspective view of a flip-open package, with the package hangtab bent at a second distance that is further backward than the first distance to provide an opened package with the clear plastic closure flap withdrawn from underneath the package front, in accordance with an embodiment of the invention.

With reference to the exemplary embodiment of FIG. 7, the flip-open package 98 is depicted with the hangtab portion 66 bent in the direction 100 at a second distance that is further backward than the first distance to provide an opened, flip-open package 98. As such, in the open position of FIG. 7, the clear plastic closure flap 62 is withdrawn from underneath the package front side 90 based on rotation of the hangtab portion 66 in the backward direction 100, away from the plane of the remaining portion of the back side 96. In response to the additional pivoting between the positioning of FIGS. 6 and 7 (i.e., further pivoting of the hangtab portion 66 about the pivot point 68), the bottom portion 82 of the closure flap 62 becomes exposed and/or removed from within the package body 52. In other words, the bottom portion 82 of the closure flap 62 becomes "untucked" based on rotation of the hangtab portion 66, and corresponding advancement of the closure flap 62 in an outward and upward direction 110.

As shown in the example of FIG. 7, based on a rigidity of the plastic material used for the closure flap 62, at least a portion of the closure flap 62 may automatically open the flip-open package 98 once the hangtab portion 66 is rotated a threshold distance in the backward direction 100. In doing so, the bottom portion 82 may "spring" out from being restrained by the upper edge 84 of the front side 90 to provide access to the inner cavity 88 of the package body 52. In further aspects, at least a portion of the closure flap 62 is coupled to at least a portion of the hangtab portion 66 such that movement of the hangtab portion 66 pulls on an end of the closure flap 62 in a direction away from the upper edge 84 of the front side 90.

In some embodiments, based on travel of the bottom portion 82, corresponding travel of at least a portion of the middle portion 80 provides further access to the inner cavity 88 of the package body 52. For example, the left tab 76 and right tab 74 of the middle portion 80 may be withdrawn from the interior cavity 88 upon rotation of the hangtab portion 66 in the backward direction 100, thereby raising the middle portion 80 and corresponding left and right tabs 76 and 74 in the upward and outward direction 110. In some aspects, based on the left tab 76 and the right tab 74 corresponding to the incline edge 106 of the left side 92 and the right side 94 of the package body 52, contents previously enclosed within the flip-open package 98 may now be accessed from multiple sides of the flip-open package 98 upon raising of the closure flap 62. In one embodiment, the left tab 76 and right tab 74 mate with opposing left and right sides 92 and 94 of the package body 52 to provide a secured interior portion 88 when the hangtab portion 66 is in a neutral position and the closure flap 62 is tucked beneath the upper edge 84 of the front side 90. One or more articles, such as the stored items 116, may be secured within the interior cavity 88 based on a mating between one or more surfaces of the package body 52 (of a first material, such as cardboard) and one or more surfaces of a closure flap 62 (of a second material, such as plastic). The secured interior cavity may then be accessed based on the separation of at least a portion of the closure flap 62 from at least a portion of the package body 52, such as the removal of the bottom portion 82, middle portion 80, and/or upper portion 78 from contact with the outer edges of the left side 92, right side 94, and front side 90, in response to rotation about the pivot point 68. In this example, the closure flap 62 remains in contact with the package body 52 at the pivot point 68 while the closure flap 62 is "flipped" into an open position. In some embodiments, although pictured as having an incline edge 106 on the left and right sides 92 and 94 of the package body 52 that correspond to the left tab 76 and right tab 74, in further embodiments of the invention, the left and right sides 92 and 94 may have any outer perimeter shape that is configured to secure one or more articles within the interior cavity 88, and need not have a particular shape or configuration including an incline edge 106. For example, the outer edge of the left and right sides 92 and 94 may have a straight edge similar to the embodiment of FIGS. 1-4, with left and right tabs 76 and 74 that correspond to the straight edges and remain tucked in with the hangtab portion 66 in the neutral position. As such, the flip-open package 10 of FIGS. 1-4 may also include side tab portions on the closure flap 24 that mate to the left and right sides 22 and 20 of the package body for further securing the interior contents.

Based on one or more features of the package 98, a user may manipulate the hangtab portion 66 by bending it in a backward direction 100, causing the subsequent opening of the closure flap 62, untucking of the bottom edge 112 from the upper edge 84, withdrawal of the left and right tabs 76 and 74 from the interior cavity 88, and/or raising of the upper portion 78 from the upper edge 108 of the left and right sides 92 and 94. In one example, the bottom portion 82 is pulled from underneath the upper edge 84 of the front side 90 based on coupling of at least a portion of the closure flap 62 to at least a portion of the package body 52, and on a travel distance of the hangtab portion 66. In further embodiments of the invention, a user may quickly access the inner cavity 88 of the package body 52 based on manual bending of a portion of the more rigid back side 96 (i.e., the hangtab portion 66) about a pivot point 68, which triggers the release of the more pliable plastic closure flap 62.

In one embodiment, the lower portion 82 of the closure flap 62 is hinged at the first fold 70 and second fold 72 such that release of the bottom edge 112 from the upper edge 84 of the front side 90 results in the upward motion of the bottom portion 82 away from the upper portion 78. Accordingly, in a first closed position, the upper portion 78 may be positioned at a first angle with respect to the middle portion 80 at the first fold 70. Further, in a second open position, the upper portion 78 may be positioned at a second angle greater than the first angle with respect to the middle portion 80 at the first fold 70. Similarly, in a first closed position, the middle portion 80 may be positioned at a third angle with respect to the bottom portion 82 at the second fold 72. Further, in a second open position, the middle portion 80 may be positioned at a fourth angle with respect to the bottom portion 82 at the second fold 72, with the third angle being different than the fourth angle based on a rigidity of the plastic material of the closure flap 62.

Figure 8:
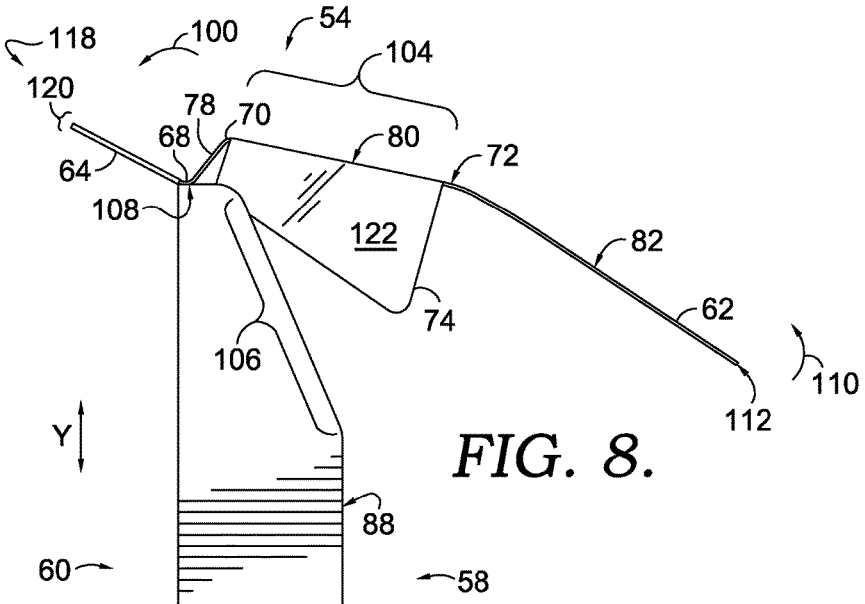
FIG. 8 is a side view of a flip-open package in an open position, in accordance with an embodiment of the invention.

In some embodiments, the flip-open package 98 may be opened by a single-handed operation, thereby allowing access to the contents of the flip-open package 98 without additional manual manipulation from a second hand. In further embodiments, a user may return the flip-open package 98 to a closed position based on tucking the closure flap 62 into the package body 52 again (i.e., under the upper edge 84 of the front side 90), which may again be released from the closed position based on subsequent rotation of the hangtab portion 66. As shown in the exemplary embodiment of FIG. 8, a side view of the flip-open package 118 depicts an orientation of the package body 52 with respect to a y-axis. In this side view example, the hangtab portion 66 includes a secured feature 64 having a structure 120 that includes the coupled first material of the back side 96 (e.g., cardboard) with the second material of the closure flap 62 (e.g., plastic) such that rotation of the hangtab portion 66 corresponds to travel of at least a portion of the back side 96 and at least a portion of the closure flap 62. In embodiments, travel of the secured feature 64 corresponds to decoupling of the top portion 78 of the closure flap 62 from the upper portion 108 of the left and right sides 92 and 94, decoupling of the cover section 104 of the middle portion 80 from the corresponding incline edge 106 of the left and right sides 92 and 94, decoupling of the side surface 122 of the left and right tabs 76 and 74 from the left and right sides 92 and 94 and the interior cavity 88, and decoupling of the bottom portion 82 from the interior cavity 88.

Figure 9:
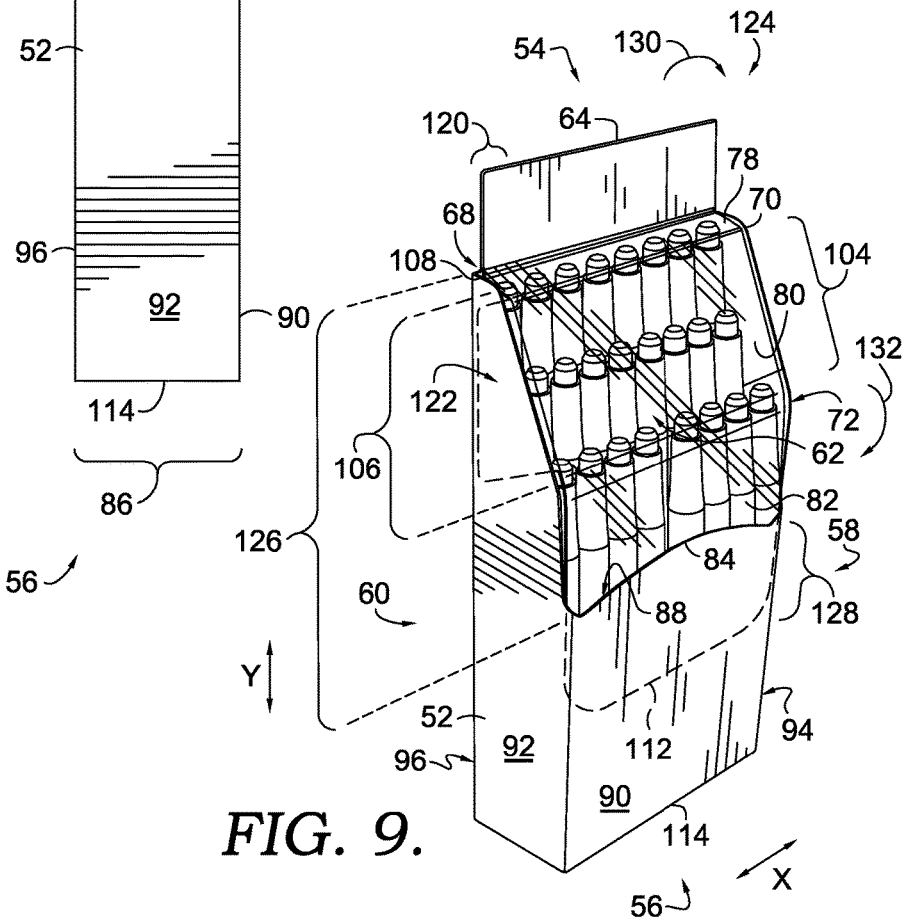
FIG. 9 is a front, perspective view of a closed, flip-open package, with hidden lines where the clear plastic flap is inserted into the base, in accordance with an embodiment of the invention.

Finally, with respect to the exemplary embodiment of FIG. 9, the mated and/or coupled portions of the first and second materials of the flip-open package 124 are shown with hidden lines associating corresponding parts of the package body 52 and the flap closure 62. In this example, the exposed portion 126 of the package body 52, with a first material having a first rigidity, is enclosed by the closure flap 62 of a second material having a second rigidity that is more pliable than the first material, such as a cardboard package body 52 and a plastic closure flap 62. Additionally, the exposed portion 126 is depicted in FIG. 9 as including the upper edge 108 of the left and right sides 92 and 94 that corresponds to the upper portion 78 of the closure flap 62, the incline edge 106 portion of the left and right sides 92 and 94 that corresponds to the cover section 104 of the middle portion 80, and the exposed surface of the bottom portion 82 of the closure flap 62 above the upper edge 84 of the front side 90. In embodiments, with the closure flap 62 tucked into the interior cavity 88 of the package body 52, an inserted portion 128 of the bottom portion 82 remains adjacent to the front side 90 with the secured feature 64 of the hangtab portion 66 in a vertical position along the y-axis. As such, the inserted portion 128 remains tucked into the interior cavity 88 with the secured feature 64 in a forward position 130 and the closure flap 62 rotated and/or biased into a downward direction 132 for securing the contents of the flip-open package 124.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A package for containing items having a flip-open package closure, the package comprising:

a package body comprising a first material, said package body comprising:

(1) a front side comprising a first length, a front side upper edge, and a front side lower edge opposite the front side upper edge;

(2) a back side comprising a second length longer than the first length, a back side upper edge, and a back side lower edge opposite the back side upper edge; and (3) a package body cavity between the front side and the back side;

a hangtab portion proximate the backside upper edge; and a closure flap comprising a second material different than the first material, said closure flap comprising an upper portion of the closure flap that is coupled to the hangtab portion, wherein the closure flap further comprises a closure flap lower portion opposite the closure flap upper portion, said closure flap lower portion configured to remain secured below the front side upper edge and inside the package body cavity when the package is in a closed position and to disengage from the front side upper edge when the package is in an open position.

2. The package of claim 1, wherein the upper edge of the closure flap is integrated into the hangtab such that the hangtab comprises a portion of the first material and a portion of the second material.

3. The package of claim 1, wherein the hangtab comprises the first material directly adjacent the second material of the closure flap.

4. The package of claim 1, wherein at least a portion of the closure flap is configured to move in response to bending of the hangtab portion in a backward direction away from the back side upper edge.

5. The package of claim 4, wherein the closure flap lower portion is configured to move in a direction away from the front side upper edge in response to bending of the hangtab portion in a backward direction away from the back side upper edge.

6. The package of claim 2, wherein the hangtab defines an aperture extending through the portion of the first material and the portion of the second material.

7. A package for enclosing items, the package comprising:

a package body comprising a first material, said package body comprising:

(1) a front side comprising a first length, a front side upper edge, a front side lower edge opposite the front side upper edge, and a front side width;

(2) a back side comprising a second length longer than the first length, a back side upper edge, a back side lower edge opposite the back side upper edge, and a back side width;

(3) a package body width corresponding to the front side width and the back side width; and (4) a package body cavity between the front side and the back side;

a hangtab portion proximate the backside upper edge of the package body, said hangtab portion comprising the first material; and a closure flap comprising a second material different than the first material, said closure flap comprising a closure flap upper portion that is coupled to the hangtab portion and a closure flap lower portion opposite the closure flap upper portion, wherein when the closure flap lower portion is directly adjacent the front side upper edge and inside the package body cavity, the package is in a closed position, and further wherein when the closure flap lower portion is separated a distance from the front side upper edge and disengaged from the front side upper edge, the package is in an open position; and wherein the closure flap lower portion is configured to move relative to the front side upper edge in response to bending of the hangtab portion in a backward direction away from the back side upper edge.

8. The package of claim 7, wherein the upper edge of the closure flap is integrated into at least a portion of the hangtab such that the hangtab comprises the first material and the second material.

9. The package of claim 7, wherein when the package is in the open position, one or more items inside the package body cavity are accessible from outside of the package body, and further wherein when the package is in the closed position, access to the one or more items inside the package body cavity is inhibited.

10. The package of claim 7, wherein the closure flap further comprises a left tab and a right tab, said left tab oriented in a plane substantially parallel to the right tab; and wherein the package body further comprises a package body left side adjacent the package body front side and the package body back side, said package body left side comprising a left upper edge and a left outer edge, and a package body right side adjacent the package body front side and the package body back side, said package body right side opposite the package body left side, wherein said package body right side comprises a right upper edge and a right outer edge.

11. The package of claim 10, wherein the closure flap left tab and the closure flap right tab are respectively configured to move relative to the package body left side and the package body right side in response to changing a position of the closure flap lower portion from a position inside the package body cavity to a position outside the package body cavity, and changing a corresponding orientation of the package body from a closed position to an open position.

12. A package for containing items having a flip-open package closure, the package comprising:

a package body comprising a first material, said package body comprising:

(1) a package body front side comprising a first length, a front side upper edge, and a front side lower edge opposite the front side upper edge;

(2) a package body back side comprising a second length longer than the first length, a back side upper edge, and a back side lower edge opposite the backside upper edge;

(3) a package body left side adjacent the package body front side and the package body back side;

(4) a package body right side adjacent the package body front side and the package body back side, said package body right side opposite the package body left side; and (5) a package body cavity between the package body front side, the package body back side, the package body left side, and the package body right side;

a hangtab portion proximate the back side upper edge; and a closure flap comprising a second material different than the first material, said closure flap comprising an upper portion of the closure flap that is coupled to the hangtab portion, a left tab, and a right tab, wherein the closure flap further comprises a closure flap lower portion configured to remain secured below the front side upper edge and inside the package body cavity when the package is in a closed position and to disengage from the front side upper edge when the package is in an open position; and wherein in response to moving the closure flap upper portion in a backward direction away from the front side upper edge:

the left tab and the right tab are respectively configured to move relative to the package body left side and the package body right side.

13. The package of claim 12, wherein the upper edge of the closure flap is integrated into the hangtab.

14. The package of claim 12, wherein the hangtab includes at least a portion of the first material and at least a portion of the second material.

15. The package of claim 14, wherein the hangtab defines an aperture extending through the portion of the first material and the portion of the second material.

16. The package of claim 12, wherein, when the package is in a closed position, the right tab and left tab inhibit access to the items contained by the package.

17. The package of claim 12, wherein the second material is an optically transparent material and the first material is an opaque material.

18. The package of claim 17, wherein the optically transparent material is a plastic and the opaque material is a cardboard material.

* * * * *